US012291367B2

(12) United States Patent
Lazarus et al.

(10) Patent No.: US 12,291,367 B2
(45) Date of Patent: May 6, 2025

(54) METHOD AND SYSTEM FOR AUTOMATICALLY PACKAGING COMMINUTED SILICON

(71) Applicant: WACKER CHEMIE AG, Munich (DE)

(72) Inventors: Werner Lazarus, Mitterskirchen (DE); Julian Garagnon, Burghausen (DE)

(73) Assignee: Wacker Chemie AG, Munich (DE)

( * ) Notice: Subject to any disclaimer, the term of this patent is extended or adjusted under 35 U.S.C. 154(b) by 0 days.

(21) Appl. No.: 18/283,463

(22) PCT Filed: Dec. 13, 2021

(86) PCT No.: PCT/EP2021/085469

§ 371 (c)(1),
(2) Date: Sep. 22, 2023

(87) PCT Pub. No.: WO2023/110055

PCT Pub. Date: Jun. 22, 2023

(65) Prior Publication Data

US 2024/0166394 A1 May 23, 2024

(51) Int. Cl.
*B65B 51/14* (2006.01)
*B65B 1/04* (2006.01)
(Continued)

(52) U.S. Cl.
CPC ..... *B65B 51/146* (2013.01); *B65B 1/04* (2013.01); *B65B 1/26* (2013.01); *B65B 7/08* (2013.01);
(Continued)

(58) Field of Classification Search
CPC ..... B65B 51/146; B65B 1/04; B65B 1/26; B65B 7/08; B65B 43/34; B65B 43/54; B65B 65/003; B65B 2220/20; B29C 65/18; B29C 66/1122; B29C 66/43121; B29C 66/80; B29C 66/8161; B29C 66/849
See application file for complete search history.

(56) References Cited

U.S. PATENT DOCUMENTS 9,623,989 B2 4/2017 Loevenich
2004/0139701 A1 7/2004 Cady et al.
(Continued)

FOREIGN PATENT DOCUMENTS

EP 2030905 A2 3/2009
EP 3199472 A1 8/2017
(Continued)

*Primary Examiner* — Veronica Martin

(57) ABSTRACT

A method of automatic packing of comminuted silicon includes providing an inner bag in a first shaping vessel, spreading out an opening of the inner bag and positioning the opening above a lip of a first filling funnel of a filling unit, and filling the inner bag with comminuted silicon. The comminuted silicon passes through the filling funnel into the inner bag. The inner bag is welded in a welding unit. The opening of the inner bag is folded together by inward folding of two opposite inner bag sides such that two inner bag edges formed by the folding-together are opposite and parallel to one another and form a fold with a channel. A vacuum welder is applied to the fold and welds the inner bag. The inner bag is transferred into an outer bag. The outer bag is welded.

18 Claims, 8 Drawing Sheets

(51) Int. Cl.

| | |
|---|---|
| ***B65B 1/26*** | (2006.01) |
| ***B65B 7/08*** | (2006.01) |
| ***B65B 43/34*** | (2006.01) |
| ***B65B 43/54*** | (2006.01) |
| ***B65B 65/00*** | (2006.01) |

(52) U.S. Cl.
CPC ..... *B65B 43/34* (2013.01); *B65B 43/54* (2013.01); *B65B 65/003* (2013.01); *B65B 2220/20* (2013.01)

(56) References Cited

U.S. PATENT DOCUMENTS

| | | | | |
|---|---|---|---|---|
| 2009/0056279 | A1* | 3/2009 | Sasaki | B65D 31/04 53/469 |
| 2018/0148198 | A1* | 5/2018 | Lazarus | B65B 25/00 |

FOREIGN PATENT DOCUMENTS

| | | | |
|---|---|---|---|
| KR | 20160001420 | A | 1/2016 |
| WO | 2016188893 | A1 | 12/2016 |

* cited by examiner

METHOD AND SYSTEM FOR AUTOMATICALLY PACKAGING COMMINUTED SILICON

CROSS-REFERENCE TO RELATED APPLICATION

This application is a U.S. National Phase Application of PCT/EP2021/085469, filed Dec. 13, 2021, the contents of which is hereby incorporated by reference in its entirety.

BACKGROUND

The invention relates to a method and to a plant for automatic packing of comminuted silicon.

Polycrystalline silicon (polysilicon) is typically produced by the Siemens process (chemical gas phase deposition process). Polysilicon is the starting material in the production of monocrystalline silicon, which can be produced, for example, by means of the Czochralski process. In addition, polysilicon is required for production of multicrystalline silicon, for example by the block casting process. For both processes, the polysilicon which is in rod form after the Siemens process has to be comminuted into chunks.

Since contamination can lead to dislocation defects (one-dimensional faults) and stacking defects (two-dimensional faults) in the crystal structure, the comminuted silicon should be packed with low contamination for transport. Typically, packing is effected in flat film bags or double-film bags made of plastic that are sealed after filling. For efficient further transport, the bags are arranged in widely varying numbers of items in outer packing, usually cardboard boxes. These may then be stacked on customary pallets and transferred into containers.

Comminuted polysilicon (chunk polysilicon) is generally a sharp-edged, non-free-flowing bulk material, wherein individual chunks may have a weight of up 750 g depending on the chunk size. On packing, it should therefore be ensured particularly that no tears arise in the course of filling of the plastic bags. Double-film bags can reduce the risk of tears.

As well as the tears caused by the filling process, the sealing of the plastic bags can be a further source of contamination. Typically, the plastic bag is at least partly evacuated prior to sealing in order to ensure a more compact bag size. For this purpose, a suction probe is usually introduced into the bag, the air is sucked out and, directly after the suction probe has been pulled out, the bag is welded. Since generally any material which is introduced into the bag from the outside can contain impurities, welding using a suction probe is a potential source of contamination.

Silicon is usually packed at least in a partly automated manner. Typically, component steps of the packing process are still executed manually, since full automation does not seem economically viable in view of the high purity demands.

WO 2016/188893 A1 describes a method of packing polysilicon, wherein the comminuted polysilicon to be packed is provided in a process dish in which a cleaning step has also been conducted beforehand. In order to transfer the polysilicon into a flat plastic bag, the process dish and the plastic bag are secured to a filling unit, wherein rotation of the filling unit results in sliding of the polysilicon into the plastic bag.

EP 3 199 472 A1 describes the filling of an upright film bag made of polyethylene (PE) with polysilicon, wherein the bag is provided in a frame. The frame is intended to prevent bulging of the bag during filling. The bag is optionally transferred into an outer PE bag after filling, with matching of the chemical properties of the PE in both bags such that they can slide as well as possible against one another. A disadvantage here is that the upright bag bulges when transferred into the outer bag and, therefore, the dimensions of the outer bag are much greater than those of the upright bag.

EP 2 030 905 A2 describes a first upright bag made of plastic for filling with polysilicon. This first upright bag is folded up from a tubular film so as to form a rectangular standing surface with a fold. After filling, the first upright bag is inserted into a larger second upright bag of the same kind, with the fold of the first upright bag coming to rest rotated by 90° compared to the fold of the second upright bag. Here too, there is generally disadvantageous bulging of the first upright bag.

This problem gave rise to the object of the present invention, namely that of providing a fully automated packing method for chunk silicon that meets the demands on the purity of the chunk silicon and also offers economic advantages.

BRIEF SUMMARY

Embodiments of a method of automatic packing of comminuted silicon are provided. In an embodiment, the method comprises the steps of providing an inner bag in a first shaping vessel, spreading out an opening of the inner bag and positioning the opening above a lip of a first filling funnel of a filling unit, and filling the inner bag with comminuted silicon. The comminuted silicon passes through the filling funnel into the inner bag. The inner bag is welded in a welding unit. The opening of the inner bag is folded together by inward folding of two opposite inner bag sides such that two inner bag edges formed by the folding-together are opposite and parallel to one another and form a fold with a channel. A vacuum welder is applied to the fold from outside sucks air out of the inner bag through the channel and welds the inner bag. The inner bag is transferred into an outer bag. The outer bag is provided in a second shaping vessel. An opening of the outer bag is spread out and the inner bag is transferred into the outer bag. The outer bag is welded.

BRIEF DESCRIPTION OF THE SEVERAL VIEWS OF THE DRAWING

The above, as well as other advantages of the present invention will become readily apparent to those skilled in the art from the following detailed description when considered in the light of the accompanying drawings in which.

DETAILED DESCRIPTION

Figure 1:
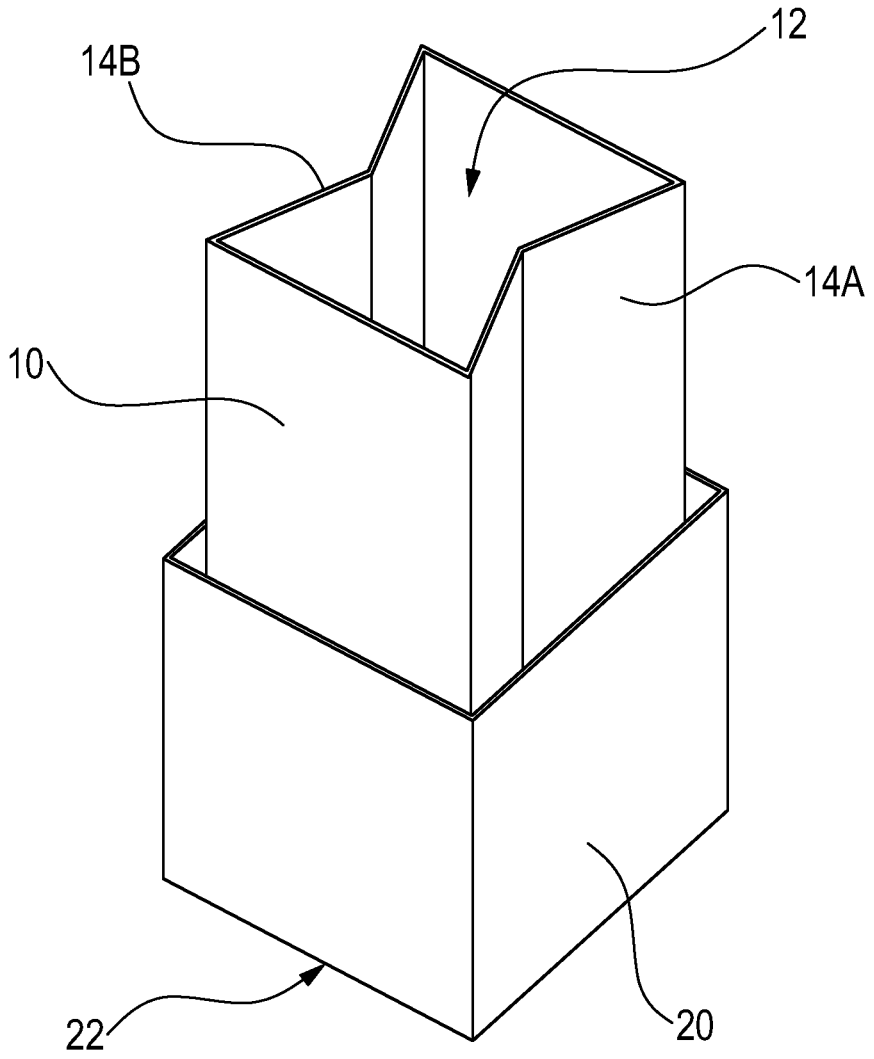
FIG. 1 is a perspective view showing an inner bag in a shaping vessel.

This object is achieved by a method of automatic packing of comminuted silicon (silicon chunks), comprising the steps of a) providing an inner bag in a first shaping vessel, b) spreading out an opening of the inner bag and positioning the opening above a lip of a first filling funnel of a filling unit, c) filling the inner bag with comminuted silicon, with the comminuted silicon passing through the filling funnel into the inner bag, d) welding the inner bag in a welding unit, wherein the opening of the inner bag is folded together by inward folding of two opposite inner bag sides such that two inner bag edges formed by the folding-together are opposite and parallel to one another and form a fold with a channel, and a vacuum welder applied to the fold from outside sucks air out of the inner bag through the channel and welds the inner bag, e) transferring the inner bag into an outer bag, wherein the outer bag is provided in a second shaping vessel, an opening of the outer bag is spread out and the inner bag is transferred into the outer bag, f) welding the outer bag.

The inner bag and/or the outer bag are preferably upright bags. It is generally a feature of upright bags that they are upright before and/or after filling. Inner bags and/or outer bags preferably have a rectangular, especially square, standing surface.

The two side lengths of the rectangular standing surface or base area of the outer bag are each longer by 3% to 35%, preferably by 4% to 30%, more preferably by 5% to 20%, than the two side lengths of the rectangular standing surface or base area of the inner bag.

For example, an upright inner bag intended for a weight of silicon of 5 kg, in the filled state, may have a length a within a range from 10 to 20 cm, a width b within a range from 10 to 20 cm and a height h within a range from 10 to 50 cm. a and b here correspond to the side lengths of the standing surface of the bag.

A typical 5 kg upright inner bag may have a square standing surface with a side length a, b of 15 cm. A corresponding typical upright outer bag may have a square standing surface having a side length a, b of 17 cm. The standing surface of the outer bag is thus 27% larger.

Preferably, the inner bag and/or the outer bag consist of a polymer film. The polymer may be PE (e.g. LDPE (low density), LLDPE (linear low density), HDPE (high density)), polyethylene terephthalate (PET), polyamide (PA) or polypropylene (PP). More preferably, inner bag and outer bag consist of LDPE. In addition, the composite film may be a two- or multilayer composite film. The thickness of the polymer film or composite film is usually within a range from 10 to 600 μm, preferably from 50 to 450 μm, more preferably from 100 to 330 μm. The inner bag and outer bag may differ with regard to the thickness of the film. It may be preferable that the outer bag is made from a more durable material than the inner bag.

Preferably, the inner bag and/or the outer bag, before they are provided in the first or second shaping vessel, are automatically preshaped directly from a high-cleanliness tubular film, centerfolded film or a gusseted tubular film. For this purpose, a film section of appropriate length is cut off and welded at one end, forming the base of the bag. Subsequently, the bag can be opened with vacuum grips, shaped by an entering shaping tube and then transferred into the shaping vessel.

The first and/or second shaping vessel preferably have the same base area as the inner bag or the outer bag. The base area of the shaping vessels is optionally up to 10% larger than the base area of the corresponding bag in order to facilitate the provision of the bags. The height of the first shaping vessel preferably corresponds to at least the fill height of the inner bag. In this way, it is possible to ensure that it is not deformed on filling. The same preferably applies to the second shaping vessel. The shaping vessels preferably consist of an antistatic material, especially of a plastic, e.g. polypropylene. Manufacturing from a metal such as aluminum is likewise possible. They may optionally have a coating of silicon in order to avoid contamination.

The first shaping vessel is preferably on a conveying device, or is connected to one. The conveying device may, for example, be a conveyor belt, a rail system or a robot arm. The conveying device can move the shaping vessel between the packing stations (e.g. filling unit, welding unit).

The opening of the inner bag is preferably positioned by conveying device above the lip of the first filling funnel of the filling unit. However, it may also be the case that the filling unit is moved toward the opening of the inner bag.

The lip preferably enters the opening of the inner bag without contact. A typical depth of entry may be 1 to 5 cm. The distance between the lip and the inner bag is preferably 0.5 to 10 mm, more preferably 1 to 5 mm.

The spreading-open of the opening in order to enable the entry of the lip into the opening is preferably effected by means of spreading fingers that enter the inner bag. The spreading fingers may be part of the filling unit. However, there may also be a separate apparatus for spreading-open that can be moved with the transport vessel. This especially comprises four spreading fingers that open up a rectangular opening.

The spreading-open is required since the opening is typically not fully widened after the provision of the inner bag.

Under some circumstances, it may even be preferable for the inner bag to be shaped before the spreading-out. This is preferably done during the provision, for example by introducing some kind of spike or a bag-shaping tube into the bag.

More preferably, however, the shaping comprises pulling the inner bag apart by means of vacuum grips. The vacuum grips may be vacuum strips or vacuum cups that are placed on from the outside. The advantage of this variant lies in a reduced risk of contamination.

The inner bag can be filled by the process according to WO 2016/188893 A1. In this case, the comminuted silicon provided in a process dish slides into the inner bag via a rotation of the filling unit.

The inner bag is preferably filled with chunk silicon of one chunk size class. In particular, it is chunk polysilicon, i.e. comminuted polysilicon. The inner bag may in principle also be filled with silicon chunks from more than one of the chunk size classes. In particular, chunk silicon of size classes 0 to 4 is dispensed.

Chunk size classes 0 to 4 (CS0 to CS4) are defined by the grain size of the chunks, with the grain size being defined as the longest distance between two points on the surface of a silicon chunk. The chunk size classes are composed of fractions having grain size ranges as follows:

CS0: 0.1 to 9 mm
CS1: 1 to 18 mm
CS2: 5 to 50 mm
CS3: 20 to 65 mm
CS4: 35 to 150 mm

The silicon chunks can be classified by means of mesh sieves, with the edge length of the square meshes corresponding to the upper limit of a CS. A CS preferably comprises at least 90% by weight of chunks within the size range specified.

Preferably, the shaping vessel with the filled inner bag is run to a welding unit for welding.

In order to obtain a pack size of maximum compactness, it is standard practice in the packing of silicon to at least partly suck the air out of the film bags prior to welding. Application of a complete vacuum is not very common since this increases the risk of tears. The air is usually sucked out with a suction probe to be introduced into the bag, which is then removed shortly before the welding. As already mentioned by way of introduction, in the packing of silicon, there should be very substantial avoidance of introduction of extraneous materials, even if only briefly, into the bag.

It has now been found that the channel formed by the specific folding-in of the two opposite inner faces of the bag can function as air channel for suction and hence obviates the need for a suction probe. An inner bag with fold and channel that has been folded together for the welding is shown in FIG. 4.

In order to facilitate the folding-in, four shaping fingers enter the opening, with the opening optionally having been pulled open or opened under tension beforehand by means of vacuum grips.

The parallel opposite inner edges of the bag are preferably formed by two shaping bars. These shaping bars can move toward one another uniformly from outside the bag. In so doing, they can fold the two opposite inner faces of the bag inward and form the opposite inner edges of the bag and hence the channel. The vacuum welder can then be moved toward the resultant fold.

The vacuum welder preferably comprises two shaping jaws each containing a heated welding wire that may be ensheathed by a nonmetallic material such as polytetrafluoroethylene. The two shaping jaws are each applied to one side of the fold. Preferably, sealing lips that surround the shaping jaws with the welding wire form a vacuum chamber after being applied, such that the air can be sucked out through the channel. Alternatively, the fold together with the shaping jaws can also be transferred into a vacuum chamber for suction.

In a preferred embodiment, a section of the fold is removed prior to the welding. This can be effected with an automatic cutting device that may be part of the welding unit. In this way, the applying of a vacuum can be simplified. In addition, the pack size and weight can be reduced. The removal can in principle also follow after the welding.

The channel preferably has a width of 1 to 15 mm, more preferably of 1.5 to 10 mm, especially of 2 to 5 mm. The width of the channel is preferably 0.5 to 5%, especially 1 to 3%, of the longer side length that forms the base area of the inner bag.

After the inner bag has been welded, it is transferred into the outer bag. The outer bag has preferably already been provided in the second shaping vessel during the welding of the inner bag. The second shaping vessel too is preferably on a conveying device, for which reference may be made to the description relating to the first shaping vessel.

With regard to the spreading-out and any necessary shaping of the outer bag too, reference may be made to the description above.

The second shaping vessel is preferably positioned beneath the welding unit. The inner bag can then be taken out of the first shaping vessel with a gripper arm and transferred into the outer bag. Alternatively, the inner bag may also be held with a gripper arm, while the first shaping vessel is moved downward and then sideways. The transfer can be implemented by lowering the inner bag into the outer bag or by raising the outer bag.

In order to facilitate the transfer of the inner bag into the outer bag, the spread-out opening of the outer bag can be run over a lip of a second filling funnel. For the distance between the lip and the immersion depth thereof, reference may be made to the above details. The second filling funnel here functions generally as a kind of frame, by means of which the inner bag can be lowered into the outer bag. In this way, it is possible to prevent a bulging inner bag from getting stuck on the spread-out opening of the outer bag.

In a preferred embodiment, for transfer of the inner bag into the outer bag, the inner bag is surrounded by a transport sleeve to maintain its shape (in order to prevent bulging). The transport sleeve preferably has the same clear dimensions as the first shaping vessel. For illustration, the transport sleeve may be described as a first shaping vessel without a base.

Preferably, the transport sleeve, after the inner bag has been welded, is positioned above the latter, such that the clear dimensions of the first shaping vessel and those of the transport sleeve are essentially congruent. By means of a gripper arm, the inner bag can then be transferred (lifted) into the transport sleeve. The two together may subsequently be moved over the spread-out opening of the outer bag or optionally over the second filling funnel, and the inner bag is lowered. More preferably, for this purpose, the transport sleeve together with the inner bag, optionally the second filling funnel, and the second shaping vessel together with the outer bag are in a perpendicular line one on top of another.

The use of the transport sleeve makes it possible to match the dimensions of inner bag and outer bag exactly to one another. So far, the size of the outer bag has been chosen such that a deformed (bulging) inner bag can also slide in without resistance. This tolerance is now no longer required, which leads to a considerable saving of material.

Preferably, after the inner bag has been transferred into the outer bag, the upstanding fold of the inner bag is folded over. More preferably, the fold is clamped between the inner bag and the outer bag. This can be executed, for example, by means of an automatically movable probe.

The welding of the outer bag is preferably effected in the same way as the welding of the inner bag. For this purpose, a further welding unit may be provided in order to increase throughput.

There optionally follows, as a further step g), transferring of the welded outer bag into a transport container. The transport container is preferably a cardboard box in which there is preferably room for six of the welded outer bags. The weight of comminuted silicon here is especially 5 kg (5 kg bag).

The entire fully automated packing method is preferably monitored with cameras, such that it is possible to dispense with manual checks.

A further aspect of the invention relates to a system for automatic packing of comminuted silicon, especially for performance of the method described. The plant comprises the following components:

- at least one first shaping vessel for an inner bag,
- at least one second shaping vessel for an outer bag,
- at least one conveying unit for movement of the two shaping vessels,
- at least one device for spreading out an opening of the inner bag and an opening of the outer bag,
- at least one filling unit for filling the inner bag with comminuted silicon,
- at least one welding unit for welding the inner bag and optionally the outer bag, comprising means of inward folding of the opening so as to form a fold with a channel; and a vacuum welder which is placed onto the inner bag or optionally the outer bag from the outside,
- at least one gripper arm for moving the inner bag,
- optionally at least one further welding unit for welding the outer bag.

The system preferably also comprises a transport sleeve by which the inner bag can be surrounded to maintain its shape.

In a further embodiment, it may be the case that the system, especially the welding unit, comprises a cutting apparatus for at least partial removal of the fold. The fold may be the fold of the inner bag and of the outer bag.

The means of folding the opening inward may especially be the described shaping bars for folding-in.

With regard to the description of the individual components and any further components present, reference may be made to the above description of the method.

LIST OF REFERENCE NUMERALS

10 upright inner bag
12 opening
13 fold of the inner bag
14A bag side
14B bag side
15A inner edge of bag
15B inner edge of bag
16 channel
17 upper end of fold
20 first shaping vessel
22 base area of the first shaping vessel
23 base area of the second shaping vessel
24 second shaping vessel
30 spreading fingers
32 filling funnel
33 lip
40 shaping bars
42 shaping fingers
50 welding unit
51 shaping jaw
52 upper sealing lip
53 lower sealing lip
54 vacuum chamber
56 cutting device
58 heating wire
59 welding wire
60 transport box
61 arrow for indication of a movement
70 upright outer bag
72 opening
73 fold of the outer bag
80 silicon chunk FIG. 1 shows an upright inner bag 10 made of LDPE that has an opening 12 and is disposed in a first shaping vessel 20 made of polypropylene (method step a)). The upright inner bag 10 has a square base area that corresponds to the likewise square internal base area 22 of the first shaping vessel 20. The upright inner bag 10 has been produced from a gusseted tubular film immediately before commencement of the method. On account of the folding of the starting material, the opposite bag sides 14A, 14B are each at a slight angle.

Figure 2B:
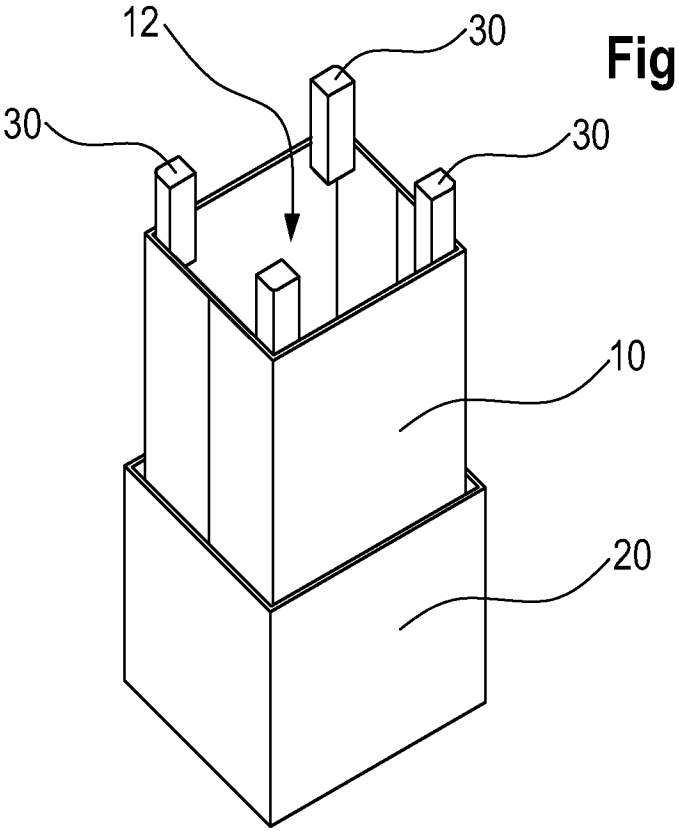
FIG. 2B is a perspective view showing an inner bag with a spread-out opening.
Figure 2A:
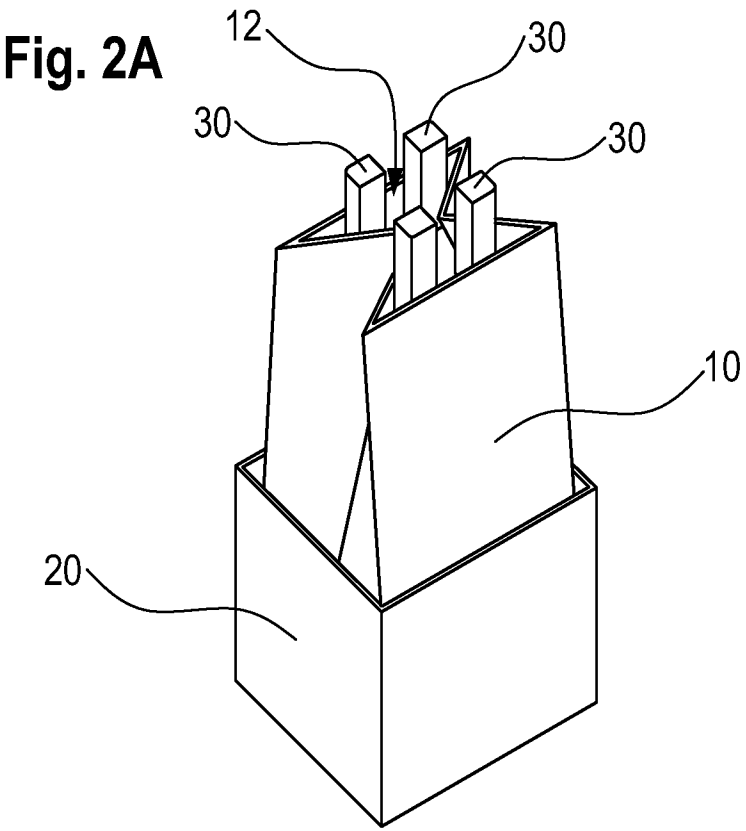
FIG. 2A is a perspective view showing an inner bag with a spread-out opening.

FIG. 2A shows the upright inner bag 10, with four spreading fingers 30 inserted into the opening 12 thereof, in order to stretch it out. The spreading fingers 30 are part of the filling unit, which is not shown for reasons of clarity. The spread-out opening 12 after the opening-out of the spreading fingers 30 is shown in FIG. 2B (method step b)).

Figure 3:
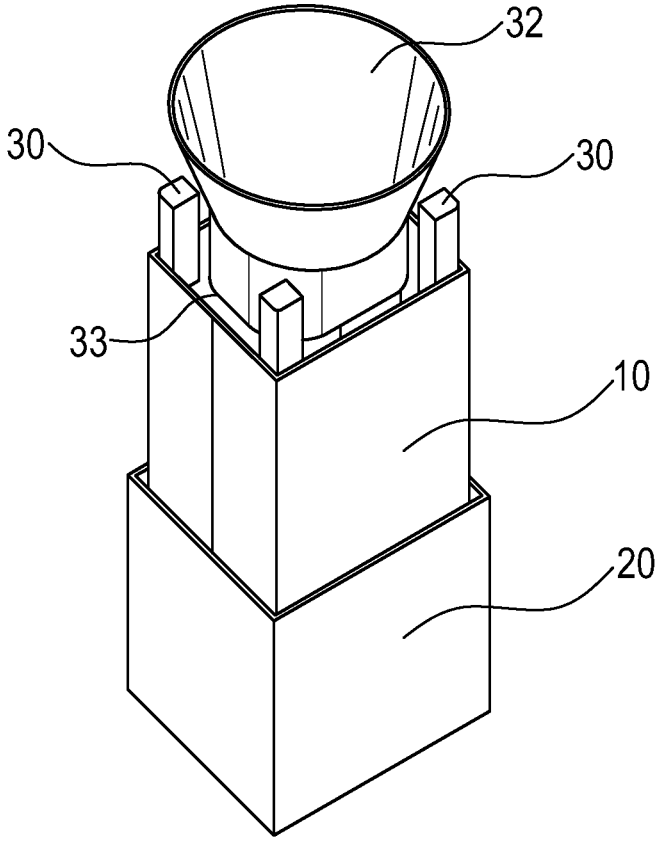
FIG. 3 is a perspective view showing the inner bag with the filing funnel.

FIG. 3 shows the upright inner bag 10 with its opening 12 spread out by the spreading fingers 30, into which a lip 33 of a filling funnel 32 dips without touching the upright inner bag 10 (method step b)). The filling funnel 32, like the spreading fingers 30, is part of the filling unit which is not shown.

Figure 4C:
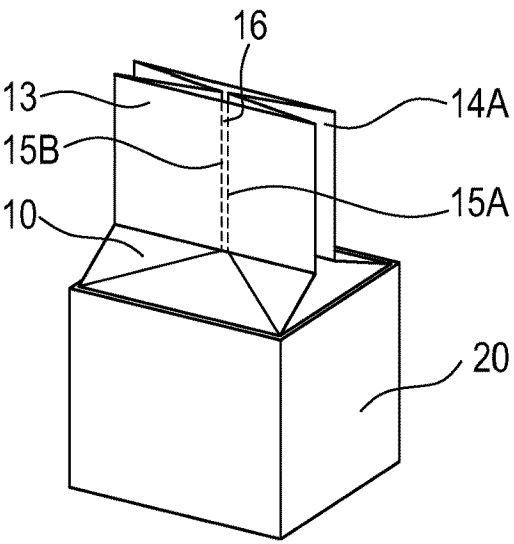
FIG. 4C is a perspective view showing the the inward folding of the inner bag.
Figure 4B:
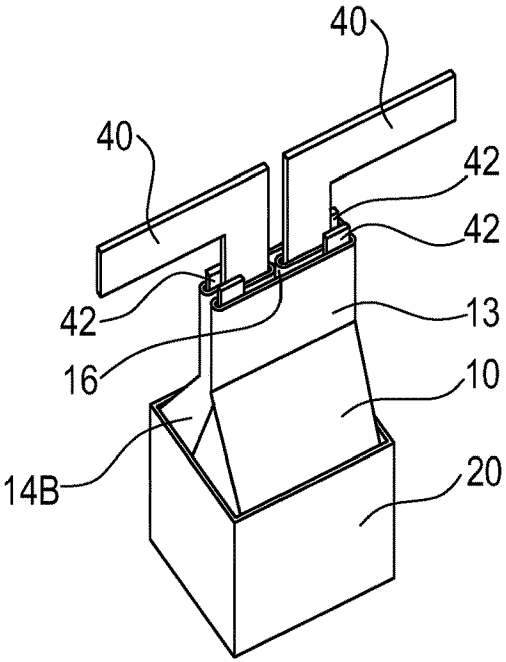
FIG. 4B is a perspective view showing the inward folding of the inner bag.
Figure 4A:
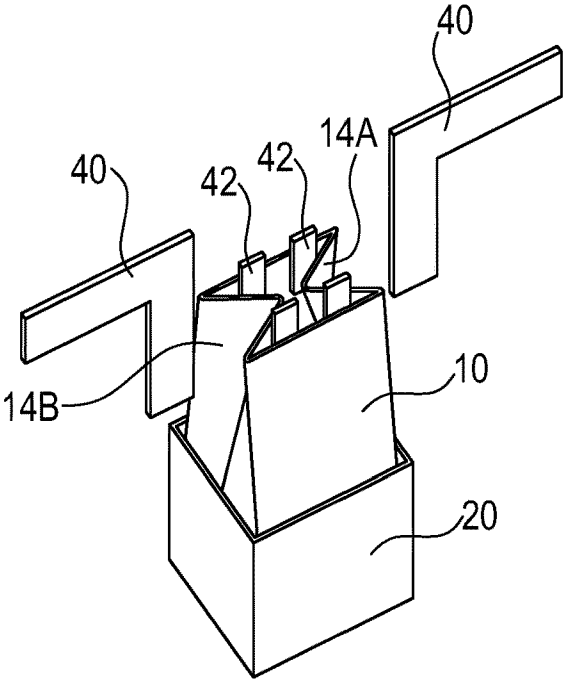
FIG. 4A is a perspective view showing the inward folding of the inner bag.

FIG. 4A shows the upright inner bag 10 after filling with comminuted silicon. For the folding-together and closing of the opening 12, four shaping fingers 42 enter the bag 10. These shaping fingers 42 may be required when the opening 12 has closed too far after the filling. Two shaping bars 40 have approached the opposite sides of the bag 14A, 14B. The shaping bars 40 and the shaping fingers 42 are part of the welding unit which is not shown.

In FIG. 4B, the shaping bars 40 have moved together and the sides of the bag 14A, 14B have been folded in. As a result, parallel opposite inner edges of the bag 15A, 15B (cf. FIG. 4C) and a fold 13 have formed. The inner edges of the bag 15A, 15B form a channel 16 that runs through the fold, with the width of the channel 16 corresponding roughly to the distance between the two shaping bars 40. The shaping fingers 42 can facilitate the formation of the fold 13 by virtue of their spacing.

FIG. 4C shows the upright inner bag 10 after the shaping bars 40 and the shaping fingers 42 have been removed. The channel 16 shaped by the inner edges of the bag 15A, 15B, which are not touching, is indicated by dotted lines for illustration.

Figure 5B:
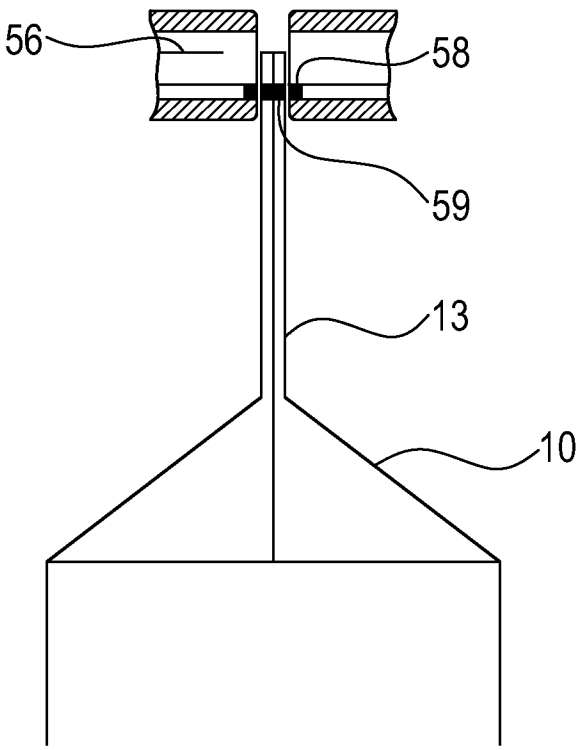
FIG. 5B is a cross-sectional view showing the welding of the inner bag.
Figure 5A:
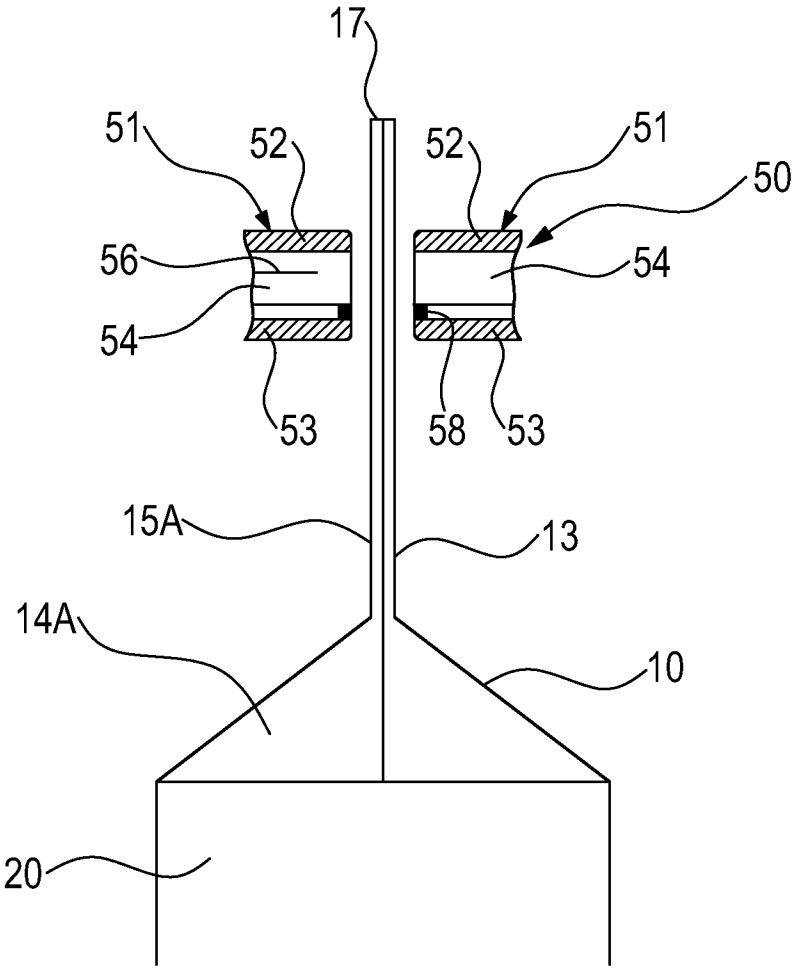
FIG. 5A is a cross-sectional view showing the welding of the inner bag.

FIG. 5A shows the upright inner bag 10 according to FIG. 4C in a side view with a welding unit 50. This comprises two shaping jaws 51, which approach the fold 13 to the left and right. Each shaping jaw 51 comprises an upper sealing lip 52 and a lower sealing lip 53 that can form a vacuum chamber 54 when the welding unit 50 is placed onto the fold 13. The welding unit 50 contains a cutting device 56 for removal of a section of the fold 13. The removal is necessary in order that the vacuum chamber 54 can form on the fold 13 after the shaping jaws 51 have been attached and can suck the air out of the upright inner bag 10 through the channel 16 (cf. FIG. 4C). It is possible to dispense with removal of a section of the fold 13 when the welding unit 50 begins at the upper end 17 (not shown).

FIG. 5B shows the bag 10 shortly after welding. The cutting device 56 has removed a section of the fold 13. The heating wire 58 has provided the fold 13 with a weld seam 59.

Figure 6:
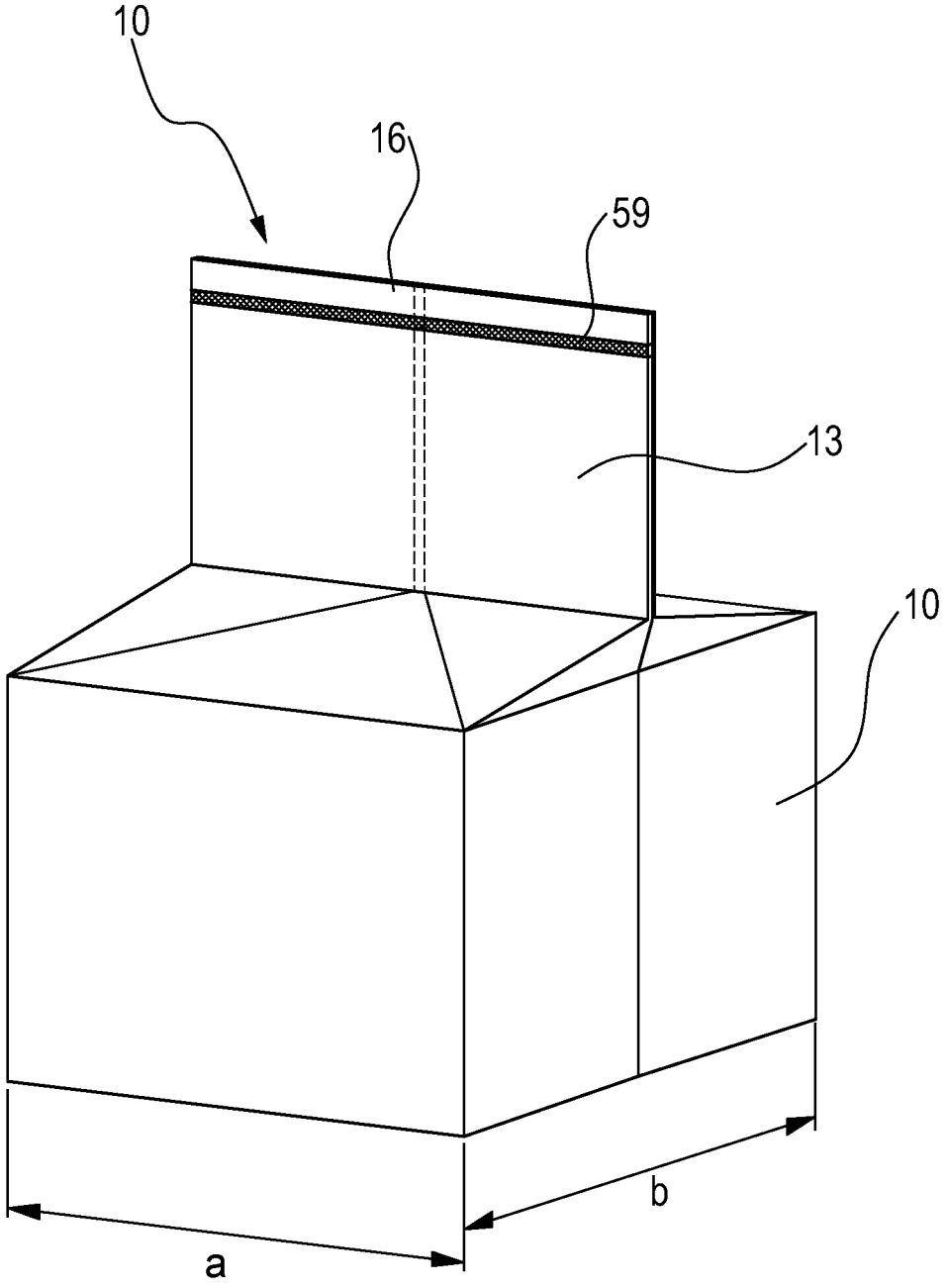
FIG. 6 is a perspective view showing a welded inner bag.

A welded upright inner bag 10 is shown in FIG. 6. The first shaping vessel 20 is not shown here. The bag is typically a 5 kg bag with square base area. A typical value of a, b is 150 mm.

Figure 7B:
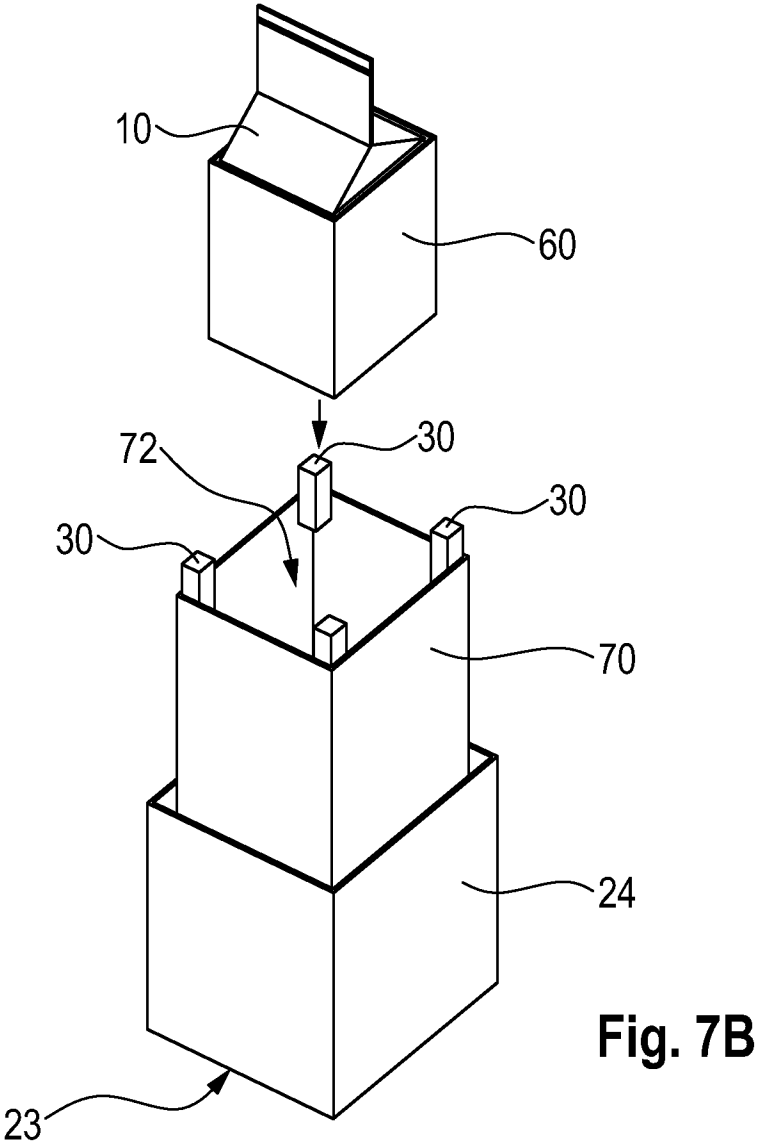
FIG. 7B is a perspective view showing the use of a transport sleeve.
Figure 7A:
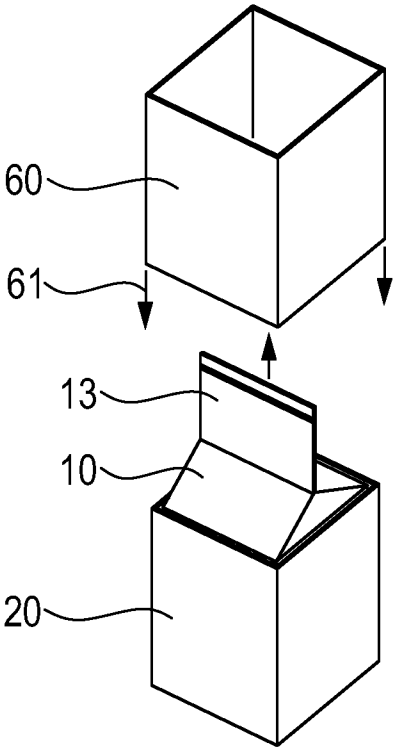
FIG. 7A is a perspective view showing the use of a transport sleeve.

FIG. 7A shows the welded upright inner bag 10 in the first shaping vessel 20, with an approaching transport sleeve 60. The transport sleeve 60 has the same clear dimensions as the first shaping vessel 20 and may be placed onto the latter. The upright inner bag 10 may, for example by means of a gripper arm, which grips the fold 13 through the transport sleeve 60 (not shown), be introduced into the transport sleeve 60 by lifting. The raising of the upright inner bag 10 and the lowering of the transport sleeve 60 are indicated by the movement arrows 61.

In FIG. 7B, the transport sleeve 60 is shown together with the welded upright inner bag 10 and a second shaping vessel 24 with an upright outer bag 70 disposed therein. The opening 72 of the upright outer bag 70 is spread open with spreading fingers 30. The upright outer bag 70 has a square base area corresponding to the square internal base area 23 of the second shaping vessel 24. The base area 23 is about 13% larger than the base area 22. The transport sleeve 60, the spread-out opening 72 of the upright outer bag 70 and the second shaping vessel 24 are arranged in a perpendicular line one on top of another. For instance, the upright inner bag 10 may be lowered into the upright outer bag 70, for example by means of a gripper arm (not shown), without any resultant bulging of the upright inner bag 10.

Figure 8:
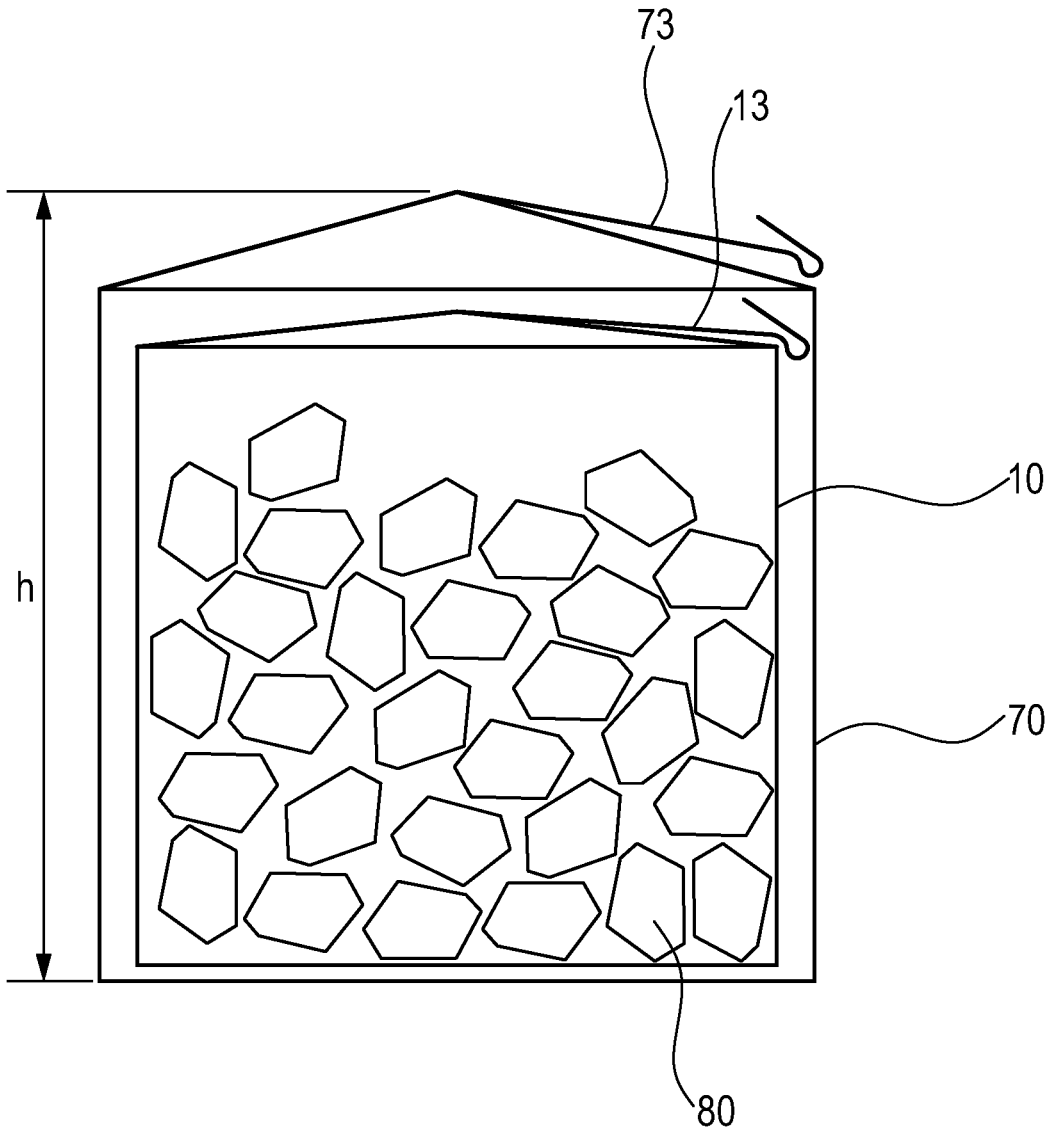
FIG. 8 is a cross-sectional view showing a welded outer bag.

FIG. 8 shows the cross section of the upright outer bag 70 with the upright inner bag 10 present therein and filled with silicon chunks 80. Both the fold 13 of the upright inner bag 10 and the fold 73 of the upright outer bag 70 are folded in. A typical height of the 5 kg bag is 220 to 240 mm. As a result, it is possible to achieve an optimal pack size in an outer packing.

On account of the use of one shaping vessel each for inner bag and outer bag, it is possible to achieve a very small pack size since bulges during and after the filling are reduced to a minimum.

The invention claimed is:

1. A method of automatic packing of comminuted silicon, comprising the steps of a) providing an inner bag in a first shaping vessel;

b) spreading out an opening of the inner bag and positioning the opening above a lip of a first filling funnel of a filling unit;

c) filling the inner bag with comminuted silicon, with the comminuted silicon passing through the first filling funnel into the inner bag;

d) welding the inner bag in a welding unit, wherein the opening of the inner bag is folded together by inward folding of two opposite inner bag sides such that two inner bag edges are opposite and parallel to one another and form a fold with a channel, and a vacuum welder applied to the fold from outside sucks air out of the inner bag through the channel and welds the inner bag;

e) transferring the inner bag into an outer bag, wherein the outer bag is provided in a second shaping vessel, an opening of the outer bag is spread out and the inner bag is transferred into the outer bag; and f) welding the outer bag.

2. The method as claimed in claim 1, wherein two side lengths of a rectangular base area of the outer bag are each longer by 3% to 35% than two side lengths of a rectangular base area of the inner bag.

3. The method as claimed in claim 1, wherein the opening of the inner bag is spread out in step b) or the opening of the outer bag is spread out in step e) by spreading fingers that dip into the inner or outer bag.

4. The method as claimed in claim 1, wherein the inner bag or the outer bag is shaped before the opening of the inner bag or the opening of the outer bag is spread out.

5. The method as claimed in claim 4, wherein the step of shaping the inner bag or the outer bag comprises pulling the inner bag or the outer bag apart by means of vacuum grips.

6. The method as claimed in claim 1, wherein, after the opening of the inner bag is folded together and before the welding of the inner bag in step d), a section of the fold is removed.

7. The method as claimed in claim 1, wherein the channel has a width of 1 to 20 mm.

8. The method as claimed in claim 1, wherein, for transfer of the inner bag into the outer bag in step e), the inner bag is surrounded by a transport sleeve to maintain a shape of the inner bag.

9. The method as claimed in claim 1, wherein, for transfer of the inner bag into the outer bag in step e), the opening of the outer bag is run over a lip of a second filling funnel.

10. The method as claimed in claim 1, wherein, after the inner bag has been transferred in step e), the fold of the inner bag is turned over.

11. The method as claimed in claim 1, wherein in step e) the welding of the outer bag is effected analogously to step d).

12. The method as claimed in claim 1, comprising, as step g), a transfer of the outer bag into a transport container.

13. The method as claimed in claim 1, wherein the opening of the inner bag is spread out in step b) and the opening of the outer bag is spread out in step e) by spreading fingers that dip into the inner or outer bag.

14. The method as claimed in claim 1, wherein the inner bag and the outer bag are shaped before the opening of the inner bag or the opening of the outer bag is spread out.

15. The method as claimed in claim 4, wherein the step of shaping the inner bag and the outer bag comprises pulling the inner bag and the outer bag apart by means of vacuum grips.

16. A system for automatic packing of silicon, comprising at least one shaping vessel for an inner bag;

at least one shaping vessel for an outer bag;

at least one conveying unit for movement of the shaping vessel for the inner bag and the shaping vessel of the outer bag;

at least one device for spreading out at least one opening, the at least one opening being an opening of the inner bag or an opening of the outer bag;

at least one filling unit for filling the inner bag with comminuted silicon;

at least one welding unit for welding the inner bag and optionally the outer bag;

comprising means of inward folding of the opening of the inner bag or the opening of the outer bag so as to form a fold with a channel; and a vacuum welder which is placed onto the inner bag or optionally the outer bag from the outside;

at least one gripper arm for moving the inner bag; and optionally at least one further welding unit for welding the outer bag.

17. The system as claimed in claim 16, comprising a transport sleeve that surrounds the inner bag to maintain a shape of the inner bag.

18. The system as claimed in claim 16, comprising a cutting device for partial removal of the fold.

* * * * *